United States Patent [19]

Young

[11] 4,313,563

[45] Feb. 2, 1982

[54] RAIL FASTENER

[75] Inventor: Hartley F. Young, Melton, Australia

[73] Assignee: Ralph McKay Limited, Victoria, Australia

[21] Appl. No.: 128,405

[22] Filed: Mar. 10, 1980

Related U.S. Application Data

[63] Continuation of Ser. No. 919,618, Jun. 27, 1978, abandoned.

[51] Int. Cl.[3] ..... E01B 9/62

[52] U.S. Cl. ..... 238/349

[58] Field of Search ..... 238/349

[56] References Cited

U.S. PATENT DOCUMENTS

| | | | |
|---|---|---|---|
| 3,067,947 | 12/1962 | Deenik et al. | 238/349 |
| 3,314,605 | 4/1967 | Waters | 238/349 |
| 3,881,652 | 5/1975 | Jacobson | 238/349 |
| 3,970,248 | 7/1976 | Molyneux | 238/349 |
| 3,982,692 | 9/1976 | Feyrer et al. | 238/349 |

FOREIGN PATENT DOCUMENTS

| | | | |
|---|---|---|---|
| 1162585 | 9/1958 | France | 238/349 |
| 186334 | 11/1963 | Sweden | 238/349 |

*Primary Examiner*—Joseph F. Peters, Jr.
*Assistant Examiner*—Ross Weaver
*Attorney, Agent, or Firm*—Buell, Blenko, Ziesenheim & Beck

[57] ABSTRACT

Rail fastening clips formed from metal plate which are formed into U shaped plate sections having tapered arms, the plate sections being subsequently bent and formed into a three dimensional rail fastener.

3 Claims, 6 Drawing Figures

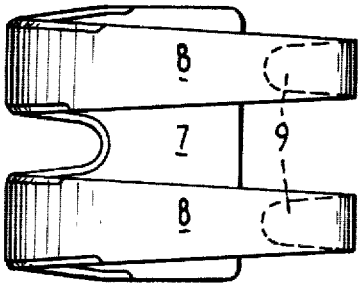
FIG. 1.
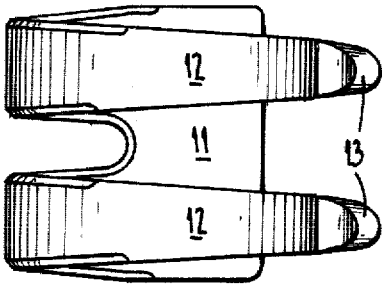
FIG. 4.
FIG. 2.
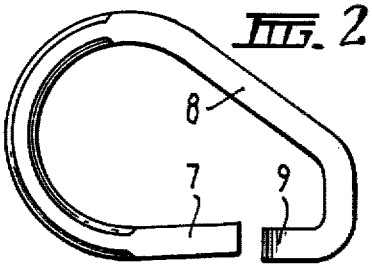
FIG. 5.
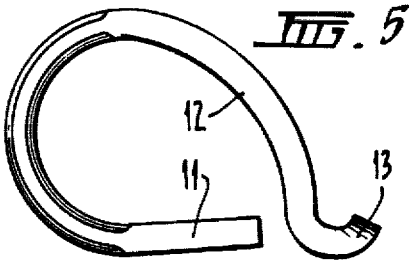
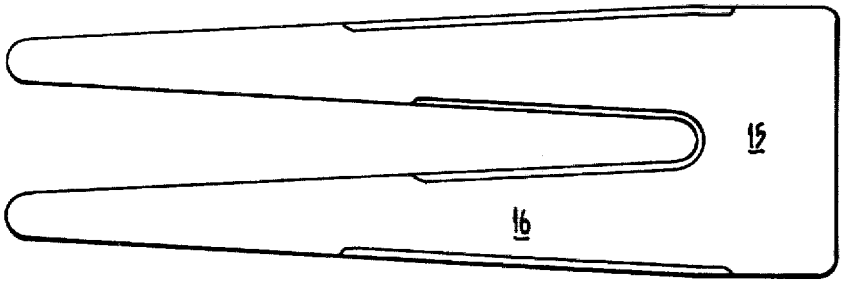
FIG. 3.
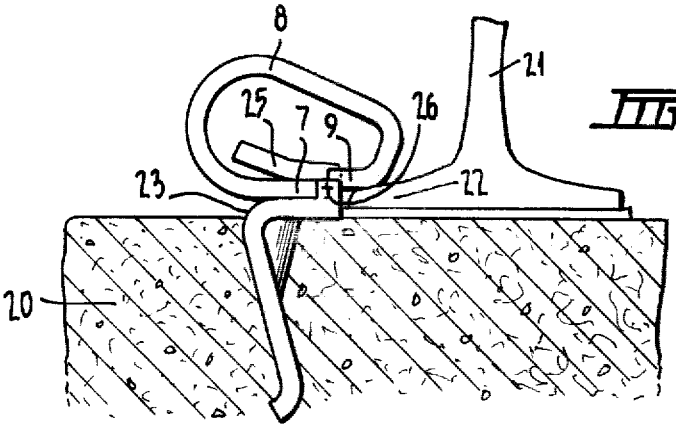
FIG. 6.

RAIL FASTENER

This application is a continuation of my copending application Ser. No. 919,618, filed June 27, 1978, now abandoned.

This invention relates to a rail fastener and to a method of producing such fasteners.

Many types of rail fastening clips have been proposed for fastening rails to sleepers. One proposal has been to use a clip comprising a U shaped drawn wire which is bent over itself to form a clip having two parallel arms of equal diameter which terminate adjacent the base of the said "U". In this construction the base of the U fits within a clip holder housing secured to a sleeper and the free ends of said clip lie on the foot of the rail clamping the rail to the sleeper.

In clamping such clips to the rail deflection of the free ends must occur. The clips defined above have a maximum working deflection of about 11 mm and in many cases where misalignment between the rail, sleeper and clip holder occurs difficulty in fitting the clip may be experienced. However, the greatest difficulty met is that where there is misalignment, unacceptable variations in the clamping force of the clip on the rail can occur. The deflection of the clips should be uniform and when the deflection range is small a misalignment can easily lead to a large variation from the norm.

To overcome this problem the present invention provides a rail clip comprising a U shaped member in which the arms of the U are bent to bring the free ends adjacent the base of the U said arms being tapered in cross section from the base of the U toward the free ends.

The term tapering is meant to include any progressive reduction in the cross sectional dimensions of the arms. For example, instead of uniform tapering, the outer edges of the arms may be parallel with the inner edges diverging to provide all of the tapering required.

It is not necessary for the tapering to extend the full length of the arms to obtain an improved deflection range for the clip. By improving the deflection range of the clip any misalignments will have a smaller effect on the clamping force and any variations will be within acceptable limits.

Another embodiment of this invention relates to the method of forming rail clips of the general kind referred to above as well as the particular clip according to the present invention.

Generally rail clips are formed from drawn rods which are bent to a U shape and then bent to the clip form. The forming techniques required as well as the starting material itself, result in an overall expensive method of making the clips.

To overcome this problem the present invention provides a method of forming rail clips comprising supplying plate material, blanking said plate to form a U shaped blank and forming the blank into a rail clip in which the free ends of the U lie adjacent the base of said U.

By using plate metal to form the strips and by blanking the basic U shape a less expensive means of forming rail clips results and the rail clips have the same quality as those produced by present day conventional methods.

The attached drawings illustrate preferred aspects of the invention in which

FIG. 1 is a plan view of a rail clip according to a first embodiment.

FIG. 2 is a side view of the clip shown in FIG. 1.

FIG. 3 is a plan of a blank from which the rail clips can be formed.

FIGS. 4 and 5 illustrate a rail clip according to a second embodiment of this invention.

FIG. 6 is a sectional view of a rail clip as shown in FIG. 1 in conjunction with a rail and sleeper.

The clip of FIGS. 1 and 2 comprises a base section 7 from which the tapered arms 8 extend in an arc and terminate in free ends 9 which extend toward the base section 7.

FIGS. 4 and 5 illustrate a similar type clip having a base section 11 tapered arms 12 which arc towards the base section 11. The tapered arms 12 terminate in free ends 13 which extend away from the base section 11.

The clips of FIGS. 1 and 2 or FIGS. 4 and 5 can be manufactured from the blank illustrated in FIG. 3. The blank is 'U' shaped comprising a base 15 and arms 16 which can be bent into the shape shown in FIGS. 1 and 2 and FIGS. 4 and 5.

FIG. 6 illustrates a sectional view of a sleeper 20 and a rail 21 having a rail foot 22. Clipholder 23, secured to the sleeper 20, includes a recess 25 into which the base section 7 of the clip shown in FIGS. 1 and 2 fits. The clipholder 23 includes a lip 26 over which the free ends 9 of the rail clip must pass to clamp onto the rail foot 22. Thus the lip 26 assists in deflecting the free ends 9 of the clip in relation to the base section 7.

The deflection which can occur in practice with the two rail clips illustrated in FIGS. 1, 2, 4 and 5 is of the order of 15 mm and thus both clips can be used where large deflections of the rail clips are needed to fasten the rail to the sleeper.

In its preferred form the method of the present invention uses metal plate in strip form which is fed to a blanking press where a blank is formed. FIG. 3 illustrates a blank for use in forming rail clips of the kind shown in FIGS. 1, 2, 4 and 5. However, the present process is equally applicable to forming clips where the cross-sectional dimensions for the arms is constant. The cross-sectional dimensions of the final clip are determined by the shape of the initial blank.

Following blanking the two dimensional blank is heated to below 1100° C. formed into its three dimensional form as shown in FIGS. 1, 2, 4 and 5. The product is then reheated to within the range of 820° C. to 900° C. and then quenched. Subsequent to quenching the clips are tempered in a tempering furnace to desired Rockwell hardness and are then allowed to cool prior to packing.

In its two aspects this invention provides a rail clip which is more versatile in its application than previously proposed clips and also a cost saving method of forming both conventional rail clips and clips of this invention.

I claim:

1. In rail fastening apparatus including a clip adapted for fastening an associated rail to an associated sleeper, said clip comprising a U-shaped member formed from metal plate having a base and two substantially uniformly tapered arms extending therefrom, each of said arms being substantially uniformly tapered over substantially its entire length to a tip portion said base adapted to be secured to said sleeper outwardly spaced from the foot of said rail, said arms being bent inwardly beyond said base in a large arc with the tip portion of said arms being bent back toward and short of said base and oriented for contact with the foot of said rail such that said arms are deflected upwardly relative to said rail to develop downward clamping forces at said tip portions tending to hold said rail on said sleeper against vertical, lateral and longitudinal movement.

2. The invention of claim 1, the end of each arm being constructed and arranged such that area contact with the foot of said rail is established when said arm is deflected.

3. The invention of claims 1, or 2, said apparatus further including a shoulder adapted to be secured to said sleeper continguous to said rail such that said shoulder tends to prevent outward movement of said rail, said shoulder being constructed and arranged to receive said clip, whereby said clip is secured to said sleeper.

* * * * *